US009427927B2

(12) United States Patent
Thies et al.

(10) Patent No.: US 9,427,927 B2
(45) Date of Patent: Aug. 30, 2016

(54) APPARATUS AND METHOD FOR FORMING STACKS OF BAGS

(75) Inventors: Joerg Christian Thies, Dissen (DE); Heinz Berlin, Wennigsen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 0 days.

(21) Appl. No.: 13/509,081

(22) PCT Filed: Nov. 2, 2010

(86) PCT No.: PCT/EP2010/066648

§ 371 (c)(1),
(2), (4) Date: Jul. 26, 2012

(87) PCT Pub. No.: WO2011/057919

PCT Pub. Date: May 19, 2011

(65) Prior Publication Data

US 2012/0282074 A1 Nov. 8, 2012

(30) Foreign Application Priority Data

Nov. 10, 2009 (DE) ..... 10 2009 046 590

(51) Int. Cl.

| | |
|---|---|
| ***B65H 29/00*** | (2006.01) |
| ***B31B 19/98*** | (2006.01) |
| ***B65H 29/32*** | (2006.01) |
| ***B65H 31/30*** | (2006.01) |
| ***B65H 31/32*** | (2006.01) |

(52) U.S. Cl.

CPC ..... *B31B 19/98* (2013.01); *B65H 29/32* (2013.01); *B65H 31/3081* (2013.01); *B65H 31/32* (2013.01); *B31B 2219/925* (2013.01); *B65H 2301/42266* (2013.01); *B65H 2701/191* (2013.01)

(58) Field of Classification Search

CPC ..... B65H 33/02; B65H 33/16; B65H 33/18; B65H 31/32; B65H 31/3081; B65H 2219/925; B65H 2701/191; B65H 2301/42266; B65G 57/00; B31B 19/98

USPC ..... 414/794.4, 788, 788.1, 788.9, 789.9, 414/790, 790.1, 790.2, 790.8, 792.7, 793, 414/922, 924; 271/213, 217, 218

See application file for complete search history.

(56) References Cited

U.S. PATENT DOCUMENTS

| | | | |
|---|---|---|---|
| 2,852,989 | A | 9/1958 | Chaplin et al. |
| 2,853,299 | A | 9/1958 | Link et al. |

(Continued)

FOREIGN PATENT DOCUMENTS

| | | |
|---|---|---|
| DE | 1 561 445 | 4/1970 |
| DE | 23 57 658 | 5/1975 |

(Continued)

*Primary Examiner* — Michael McCullough
*Assistant Examiner* — Lynn Schwenning
(74) *Attorney, Agent, or Firm* — Jacobson Holman, PLLC.

(57) ABSTRACT

A device for forming stacks of bags, preferably bags of paper, which are individually supplied, includes at least a first transport device with which individual bags are taken up, a collection point to which the bags are fed by the transport device and in which a stack of bags can be produced, and a release device with which the bags are released from the transport device and dropped at the collection point. The device has at least one separation device, which can be inserted into or above the stack at the collection point, to divide the stack into a first and a second stack.

19 Claims, 9 Drawing Sheets

(56) References Cited

U.S. PATENT DOCUMENTS

| | | | | |
|---|---|---|---|---|
| 3,643,816 | A * | 2/1972 | Jacobsen | 414/788.9 |
| 3,889,824 | A * | 6/1975 | Wood | 414/790.3 |
| 4,131,208 | A * | 12/1978 | Vuilleumier | B65G 59/067 271/125 |
| 4,195,959 | A * | 4/1980 | Schmitt | 414/788.9 |
| 4,270,908 | A | 6/1981 | Lehmacher | |
| 4,433,599 | A | 2/1984 | Mundus et al. | |
| 4,436,472 | A | 3/1984 | Kunzmann | |
| 4,457,665 | A * | 7/1984 | Fluck | B65G 59/067 221/262 |
| 5,131,647 | A | 7/1992 | Henn et al. | |
| 5,545,001 | A | 8/1996 | Capdeboscq | |
| 5,915,688 | A | 6/1999 | Klenk et al. | |
| 6,481,952 | B2 * | 11/2002 | Deutschle et al. | 414/790.8 |
| 6,497,549 | B2 * | 12/2002 | Brown | 414/790.3 |
| 7,178,801 | B2 * | 2/2007 | Kokubo et al. | 271/213 |
| 8,002,279 | B2 * | 8/2011 | Chetrit Russi et al. | 271/312 |
| 2002/0081188 | A1 | 6/2002 | Brown | |
| 2002/0084578 | A1 | 7/2002 | Deutschle et al. | |
| 2010/0013146 | A1 * | 1/2010 | Chetrit Russi et al. | 271/196 |

FOREIGN PATENT DOCUMENTS

| | | | | |
|---|---|---|---|---|
| DE | 28 19 563 | | 11/1979 | |
| DE | 30 40 021 | | 5/1982 | |
| DE | 30 43 035 | | 6/1982 | |
| DE | 30 46 107 | | 6/1982 | |
| DE | 199 28 367 | | 12/2000 | |
| DE | 201 20 735 | | 3/2002 | |
| DE | 20 2007 002 477 | | 6/2007 | |
| EP | 0 450 333 | | 10/1991 | |
| EP | 0 773 179 | | 5/1997 | |
| EP | 0 801 019 | | 10/1997 | |
| GB | 1188357 | | 4/1970 | |
| WO | WO 2006035085 | * | 4/2006 | B65H 31/30 |

* cited by examiner

APPARATUS AND METHOD FOR FORMING STACKS OF BAGS

CROSS-REFERENCE TO RELATED APPLICATIONS

This is a national stage of PCT/EP10/066648 filed Nov. 2, 2010 and published in German, which claims the priority of German number 10 2009 046 590.1 filed Nov. 10, 2009, hereby incorporated by reference.

BACKGROUND OF THE INVENTION

1. Field of Invention

The invention relates to a device for forming stacks of bags which are individually supplied. The device has at least a first transport device with which individual bags are taken up, a collection point to which the bags are fed by the transport device and in which a stack of bags can be produced a release device with which the bags are released from the transport device and dropped at the collection point, and at least one separation device which can be inserted into or above the stack at the collection point to divide the stack into a first stack and a second stack. The invention also relates to a method of forming stacks with the inventive device.

2. Description of the Prior Art

Bags are produced individually in an apparatus for producing bags. Plastic bags are usually provided with welds and usually separated at the same time. For the production of paper bags, first tubes are formed from sheets of paper and then pieces of the tube separated. A bottom is formed at the leading end of each piece of paper tube.

The bags so formed are stacked in an apparatus for forming stacks, so that the bags are removed in batches and packaged and/or processed further.

Such an apparatus for producing stacks is disclosed in published patent application DE 30 40 021 A1. A transport device is shown which fixes an individual bag from above to the lower run of a suction tape by means of a negative pressure and draws the bag towards a collection point. The bag is detached from the suction belt by means of a separation device while a pressing device presses the bag down at the collection point. The bag is detached from the suction openings of the suction tape. Once, a stack with a desired number of bags has been formed in this way, a conveyor belt on which the stack has been formed moves them on. Then, a new stack is formed at a free collection point of the conveyor belt.

The disadvantage of this arrangement is that the feed rate and thus the speed of the bag-making machine is very limited. If the feed rate is increased, the previous stack may not beat a sufficient distanced at the beginning of the forming of the new stack. This disadvantage is acceptable In the manufacture of foil bags because the production speed is limited by other factors.

However, in the manufacture of paper bags where speeds of over 1,000 bags per minute may occur, this limitation due to the said stacking limitation is undesirable.

DE 20 2007 002 477 U1, therefore, provides two collection facilities, but this arrangement leads to a large space demands and is also likely to be expensive.

SUMMARY OF THE INVENTION

The object of the present invention is, therefore, to propose a device and a method for forming stacks of bags where the stack forming speed is sufficiently high and the space requirements are minimal.

The object is achieved by an inventive device having the characterizing features described herein, including a separation device and a slider.

Accordingly, a separation device is provided that can be inserted into or above the stack at the collection point to divide the stack into a first and a second stack.

A separation device can be inserted at high speed into the stack or above the already formed stack. Preferably this separation device is inserted above the stack when the stack has reached the desired number of bags. The following bags are then placed above the separation device. Some of the bags lie on the separation device. The first stack formed in this manner, which is located below the separation device, can now be removed without significantly affecting the second stack being started above the separation device. As the insertion of the separation device can be effected within a few milliseconds, this process is usually completed before the first bag of the second stack reaches the collection point. The separation device does not need to cover the entire surface of a bag completely. It is sufficient when only one edge, preferably the leading edge in the direction of the transport of the bag, is covered.

It is particularly advantageous if the separation device comprises at least one holding device with which at least the lower bag of the second stack can be held. This holding device enables the newly-begun second stack to be fixed in position. In this way, the effect of the removal of the first stack is minimized.

In an advantageous embodiment of the invention, the separation device has at least one wedge-shaped finger. Such a wedge-shaped element can be inserted easily between two bags without any resultant problems. This form is advantageous when the first bag of the second stack has already dropped while the element is still moving.

In a preferred embodiment of the invention, the separation device has at least one hole subject to a negative pressure. This suction hole thus serves as a holding facility. This embodiment is useful because devices for bag making have a number of suction openings and there are, therefore, already means available for providing negative pressure, for example in the form of a vacuum pump.

Further embodiments of the invention are apparent from the description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
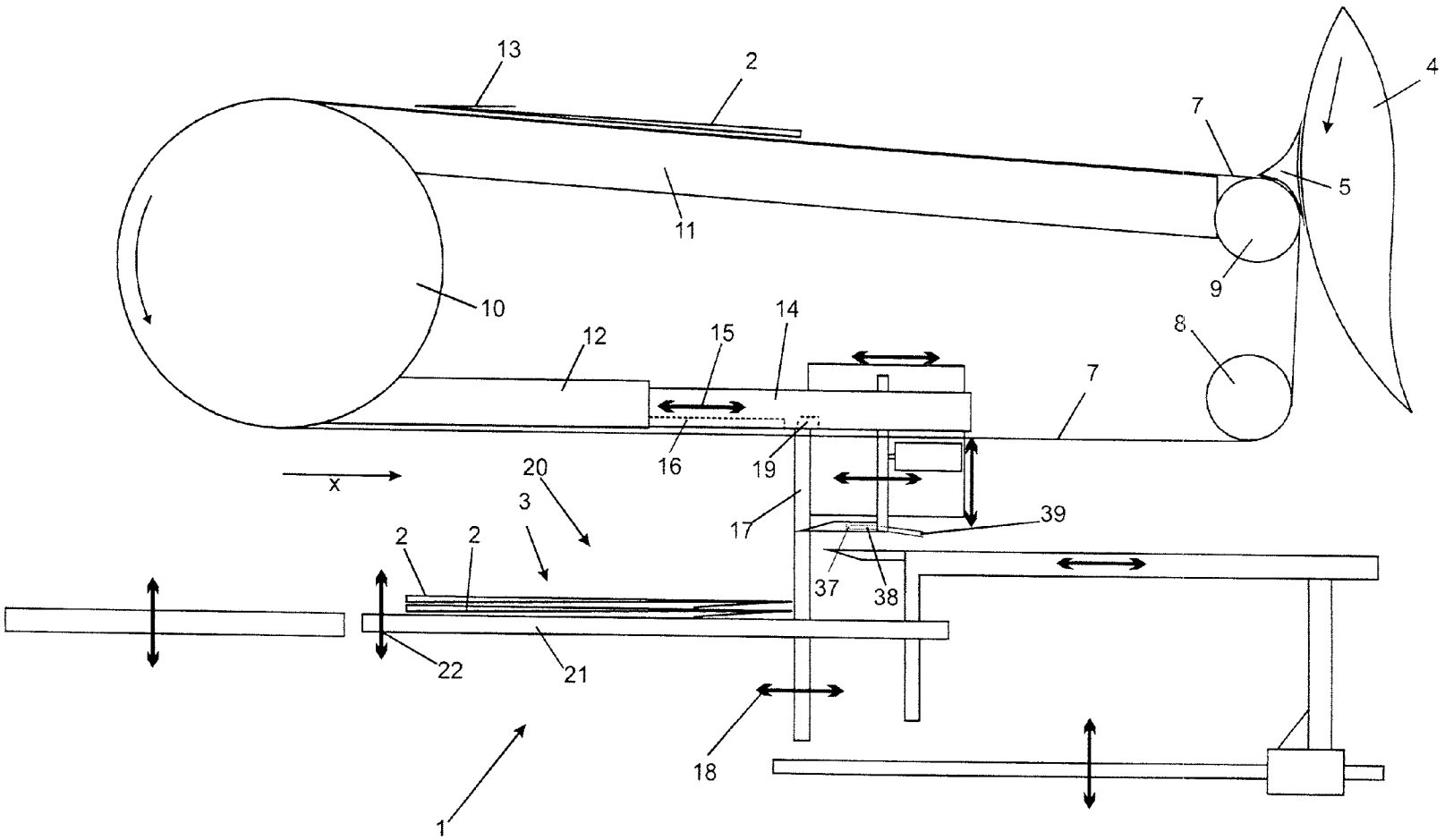
FIG. 1 Side view of a device according to the invention

FIG. 1 shows a device 1 according to the invention for forming stacks 3 of bags 2. These bags 2 are made in an apparatus for producing bags and the storage cylinder 4 is shown. The detachment finger 5 detaches individual bags from the storage cylinder and defects them onto the transport belt(s) 7 of the transport device 6. Each bag is transported with its folded end 13 leading. The folded end 13 thus forms the bottom and faces outwards, so that the bag with its rear side rests completely against the conveyor belt.

The transport device 6 comprises a number of adjacent conveyor belts 7 that rotate at the same speed. They run over the pulleys 8, 9, and 10, although more or fewer pulleys may be provided. The bag 2 can be fixed in various ways during the transport on the conveyor belt 7. One possible embodiment, using suction means of negative pressure, is already described in DE 30 40 021 A1. In this case, the conveyor belts have suction openings, whose respective distance is greater than the greatest length of the bags that can be produced by the bag machine. The transport belt 7 is guided over suction boxes 11, 12, each of which is connected to a vacuum source, although this is not shown in detail. The pulley 10 is also designed so that the suction openings of the conveyor belt 7 can be subjected to a negative pressure.

In order to be able to guide bags of variable length completely around the pulley 10, the suction box 12 has an extension 14 that is displaceable in the direction of the double arrow 15. The broken line shows the prolonging recess 16 of the groove of the suction box 12 (not shown). Therefore, as long as the suction opening of the conveyor belt 18 lies above this recess 16, the bag can be held. The release of the bag 2 is only possible at the end of the recess while the stop 17, which limits the transport path of the bag 2, is movable in the direction of the double arrow 18 by means of the extension 14. The stop 17 may be shaped like a rake or a fork that is able to pass between the individual conveyor belts 7. The extension 14 and the stop 17 are displaceable by means of a suitable adjusting device (not shown). This adjusting device may be in the form of a spindle/spindle nut combination that can be operated manually and/or by a motor, for example, an electric motor. Other adjustment arrangements are conceivable. The adjusting device can be mounted on a wall or column (not shown) of the machine frame.

In order not to damage the bag on release after removal of the negative pressure, the extension 14 comprises a further opening 19 which is pressurized with a positive pressure. Therefore, when the suction openings of the transport belt 7 pass this opening, the bags 2 are released properly.

Figure 2:
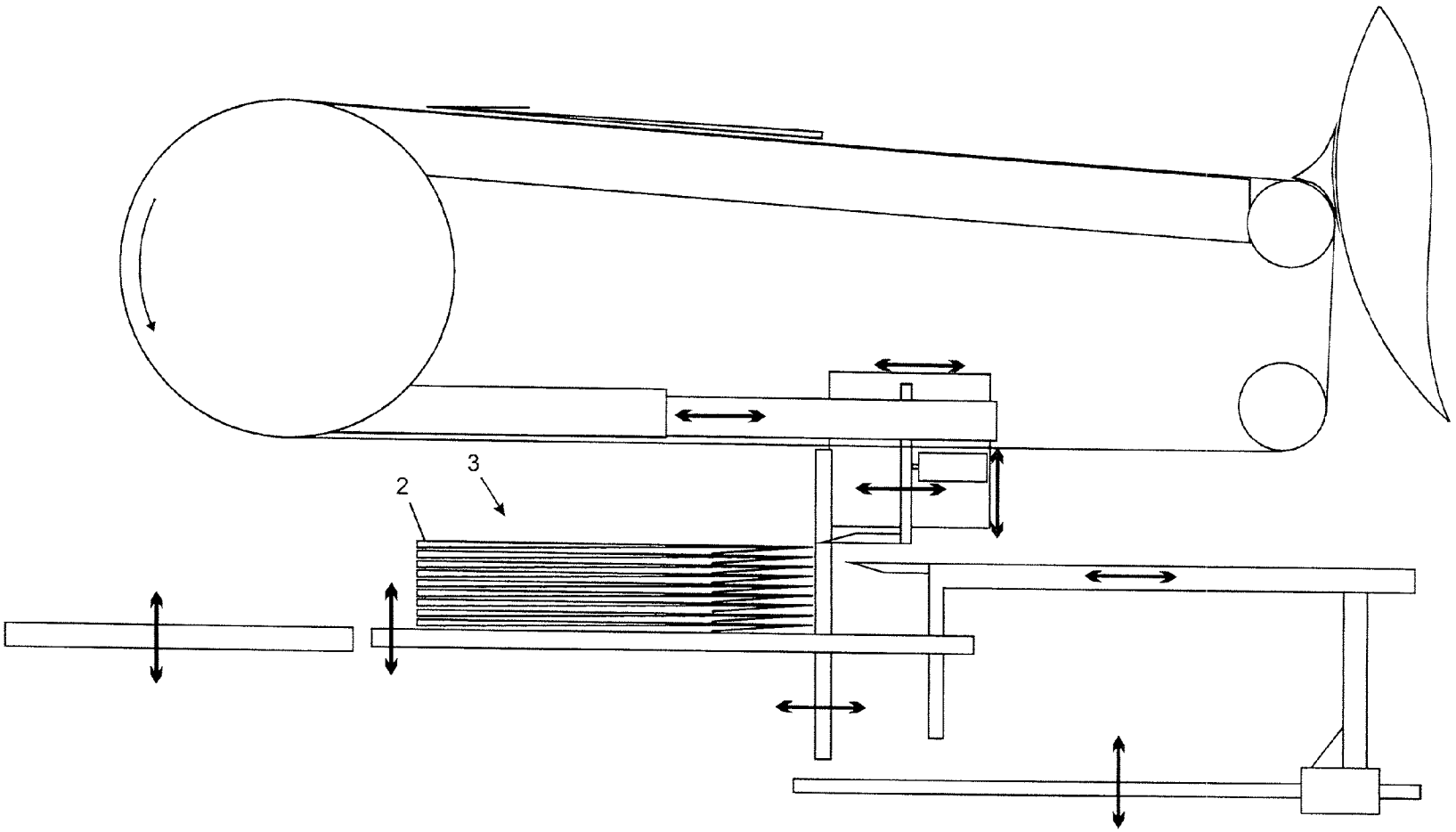
FIG. 2 Device according to FIG. 1 during formation of a first stack

The bags 2 thus conveyed and released at the stop 17 are deposited at the collection point 20 in a stack 3. The collection point 20 comprises a collection table 21 having a number of parallel ridges that are not shown in the illustration. These ridges pass through the stop 17. The collection table 21 is movable along the double arrow 22 and can, following each release of a bag, be moved downward by a small distance that is correlated with the thickness of the bag 2. In this way, a stack 3 of bags 2 is produced until it contains the desired number of bags. Such a situation is shown in FIG. 2.

Figure 3:
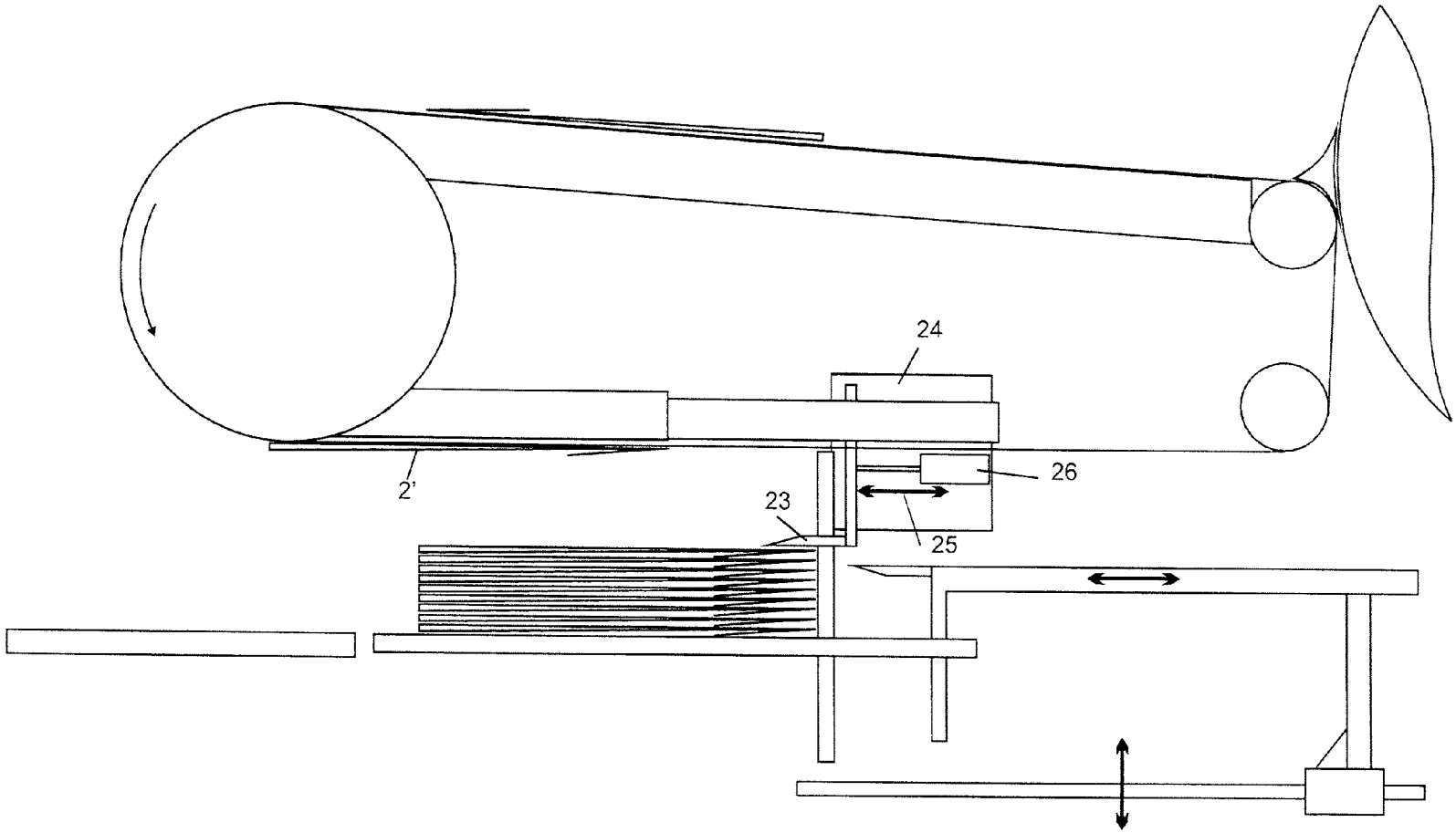
FIG. 3 Device according to FIG. 1 after insertion of a separation device FIG. 4 Device according to FIG. 1 during formation of a second stack FIG. 5 Device according to FIG. 1 during removal of the first stack FIG. 6 Device according to FIG. 1 after the removal of the first stack FIG. 7 Device according to FIG. 1 during the withdrawal of the slide.

In order to be able to start a new stack, the separation fingers 23 of the separation device can now be inserted above this stack in the area of the collection point 20. FIG. 3 shows the device after insertion of the separation fingers 23. For this purpose, the separation fingers 23 can be displaced by means of a holding device 24, for example a retaining plate. The displacement directions are indicated by the double arrow 25. A piston-cylinder unit may be provided as a displacement drive 26. However, any other kind of very fast acting actuator may be used. Linear motors would be also be of advantage here because of their speed and very high positioning accuracy. The displacement actuator 26 is supported on the holding device 24. The insertion of the separation finger 23 is effected so rapidly that the first succeeding bag 2' can be released onto the separation fingers 23. In this way, the separation fingers separate the first completed stack from the newly-begun stack 3'.

With the growth of the stack 3', the separation fingers 23 must also be simultaneously moved downward to the collection table 21. For this purpose, the holding plate 24 is displaceable in the vertical direction of movement as shown by the double arrow 27. Here, too, various suitable displacement means are conceivable. The holding plate can be operatively connected with the collection table 21 to enable common displacement. In this case, the holding plate and/or the separation fingers 23 with the sliding drive 26 must be displaceable with respect to the collection table in order to adjust to the desired stack height. However, this adjustment must only be carried out before production. In contrast, the displacement of the collection table and the holding plate takes place during bag production. Therefore, a motor-driven, precisely positioned displacement device is provided to this end. The holding plate 24 must be displaceable along the double arrow 28 synchronously with the stop 17 and/or the extension 14 in order to adapt to the bag length.

The first stack 3, which is now below stack 3' that is being formed, can now be removed.

Figure 4:
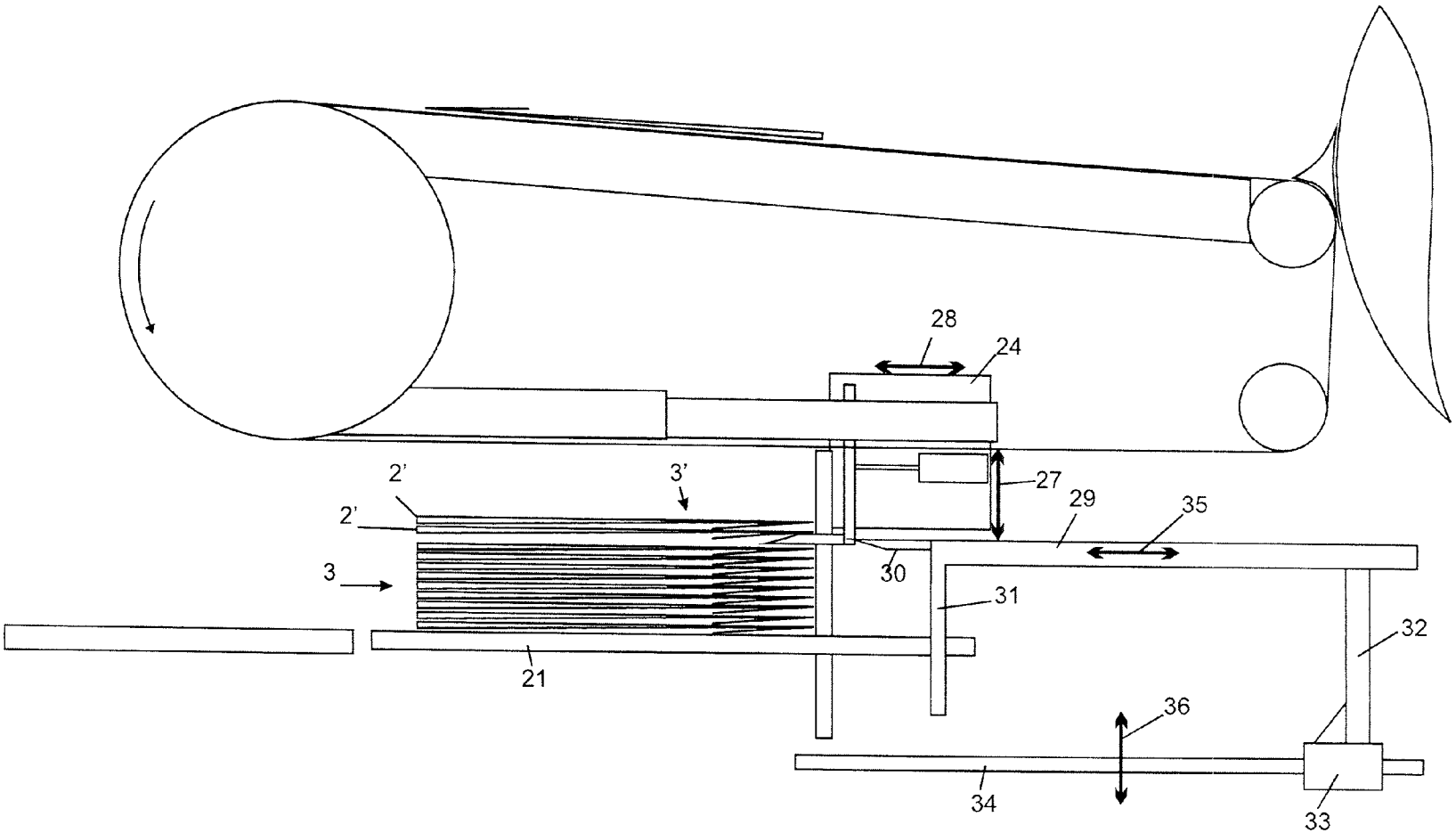
Figure 5:
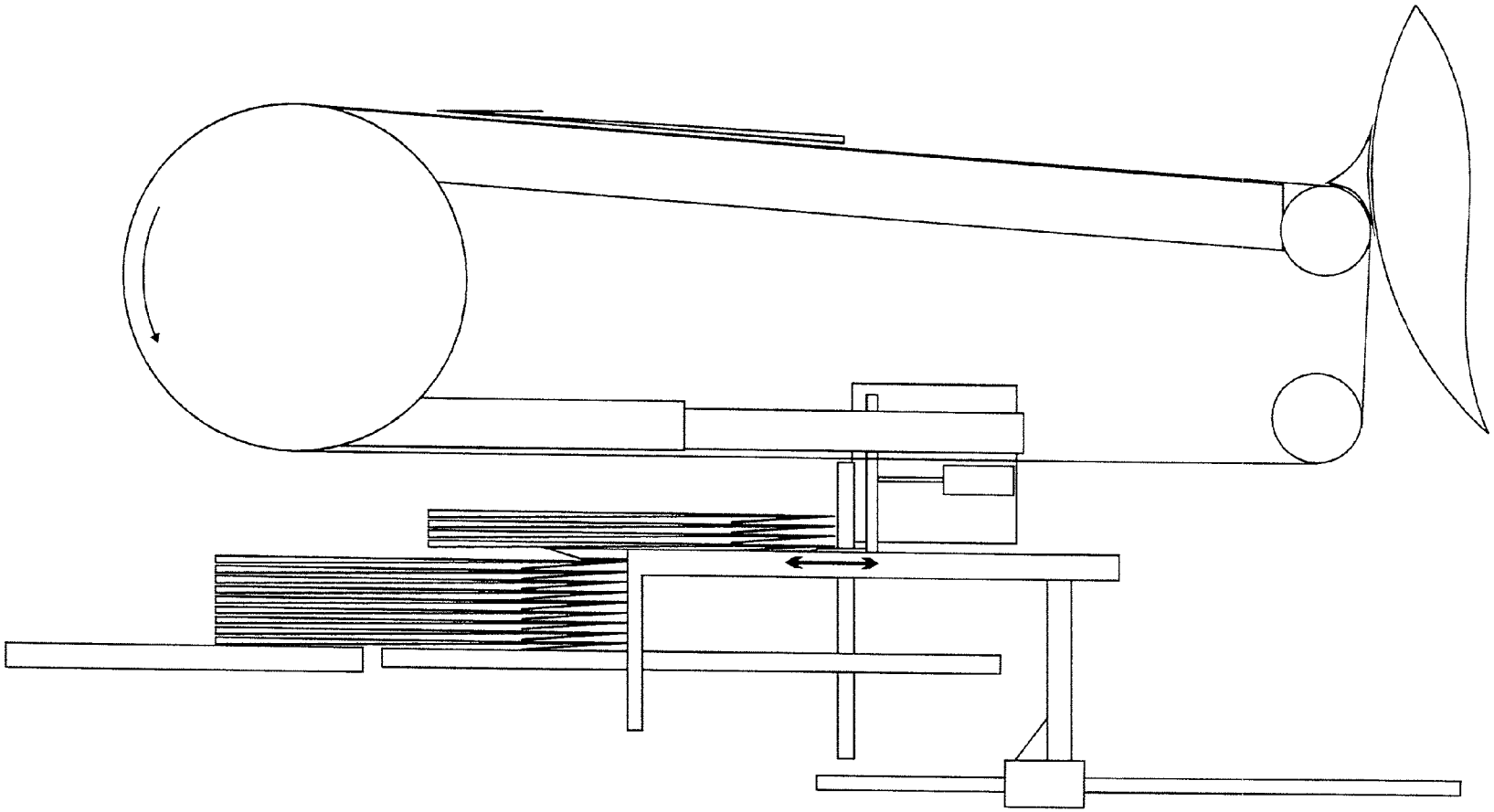

For this purpose, a slider 29 is provided, comprising a number of bars (only the front is visible). Positioning elements 31 are provided at right angles to the slider that take the form of a fork between the ridges of the collection table 21. The positioning elements 31 are still superposed by a wedge 30 or several wedges that can be inserted through the free space created by the separation fingers 23 between the stack 3 and the stack 3'. The slider 29 is supported on a support means 32 that is, in turn, connected to a carriage 33. This carriage 33 is shown along a rail assembly 34; in this case, the example here is of a single rail, sliding in the direction of the double arrow 35. The rail assembly is also displaceable in the direction of the double arrow 36 so that the vertical position of the slider 29 is adaptable to the position of the said free space. Following the adjustment to this position, which is shown in FIG. 4, the slider can be moved along the displacement direction 35. This is shown in FIG. 5. During the displacement process, the new stack 3' is formed on the facing surface of the stack 3'. The slider can thus take over the function of the collection table 21 during this period.

Figure 9:
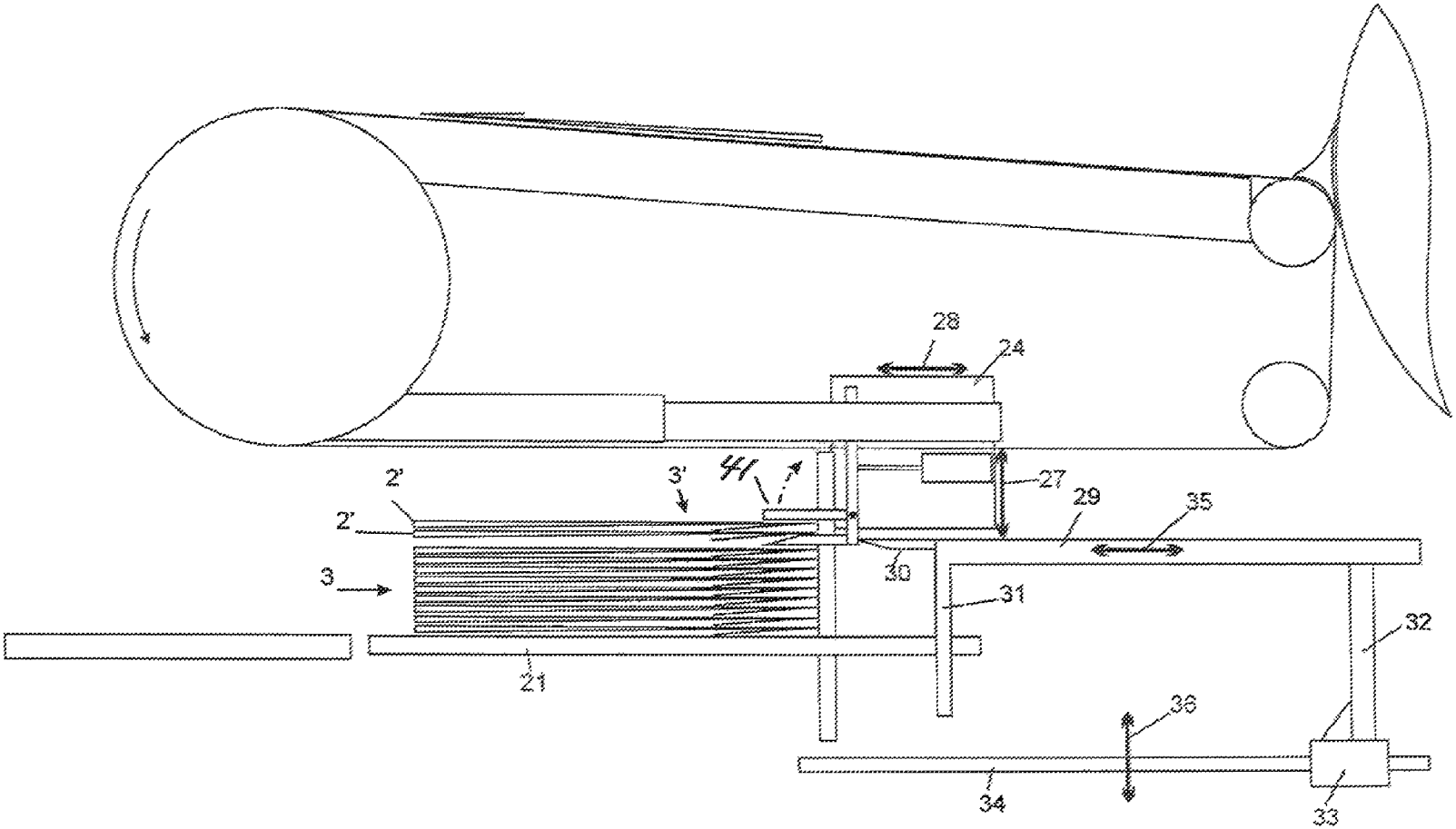
FIG. 9 illustrates an embodiment of the device in which the separation device includes a gripper.

It is essential that at least the lower bag of the stack 3' can be held stable in its position with respect to the collection table 20 by means of a holding device so that the newly-begun stack 3' is not displaced. Any displacement of the bags can result in a poor stack quality, which should be avoided. For this reason, in the illustrated embodiment, the separation finger 23 has openings 37 on the upper side which are subject to a negative pressure. This negative pressure can already be present when the first bag 2 of the new stack 3 rests on the separation finger 23. This can lead to an improvement in the quality of the stack 3' during its formation. The opening 37 as well as the channels 38 and the suction line 39 are shown in FIG. 1. Instead, the holding means may, for example, be mechanical. One or more grips 41 (see FIG. 9) could seize at least the lower bag. Holding devices based on other physical operating principles are also conceivable.

Thus, an electrostatic attractive force can be used for such purposes. This is particularly applicable when the bag has, for example, a window made of a plastic material.

Figure 6:
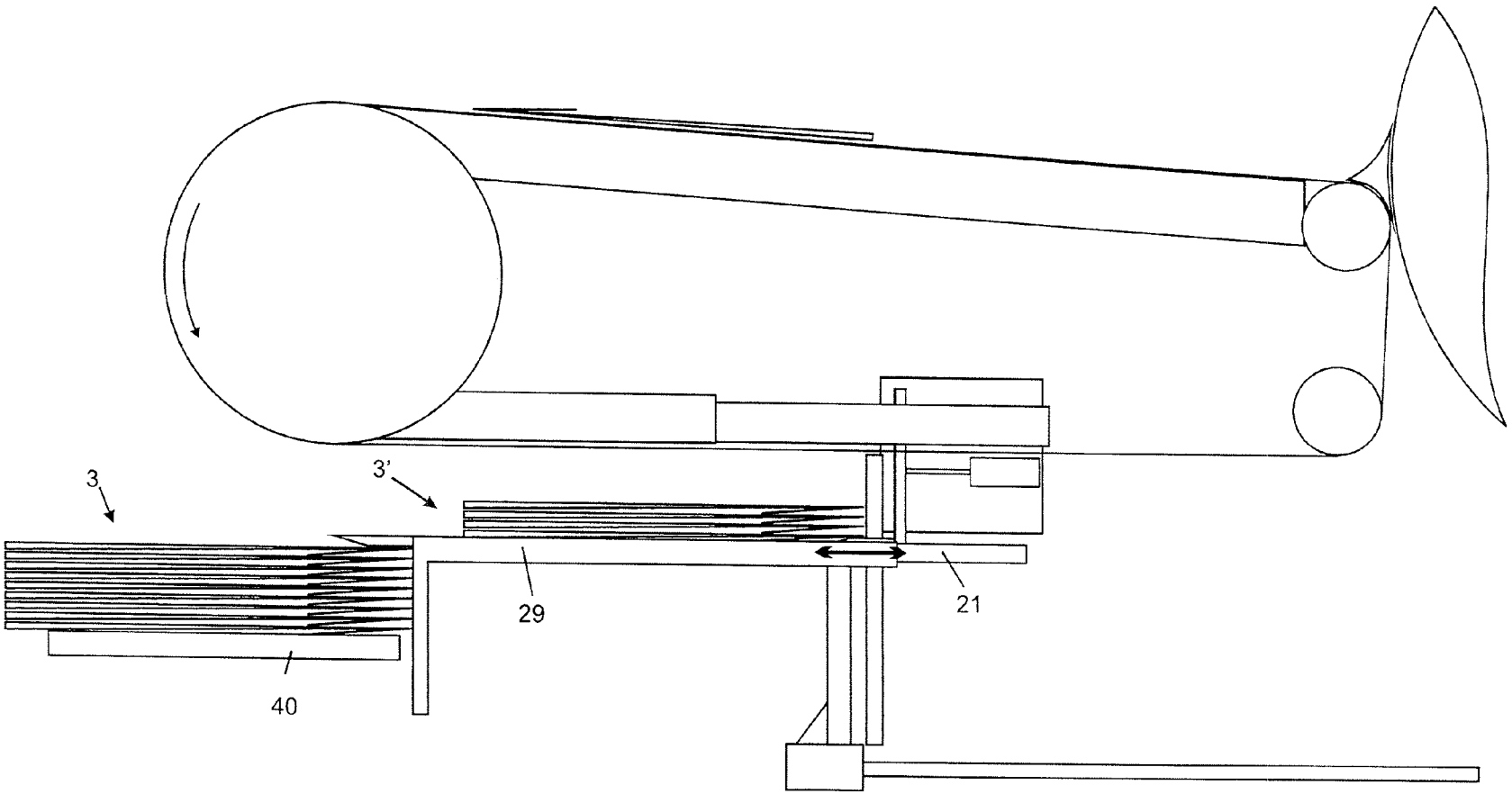
Figure 7:
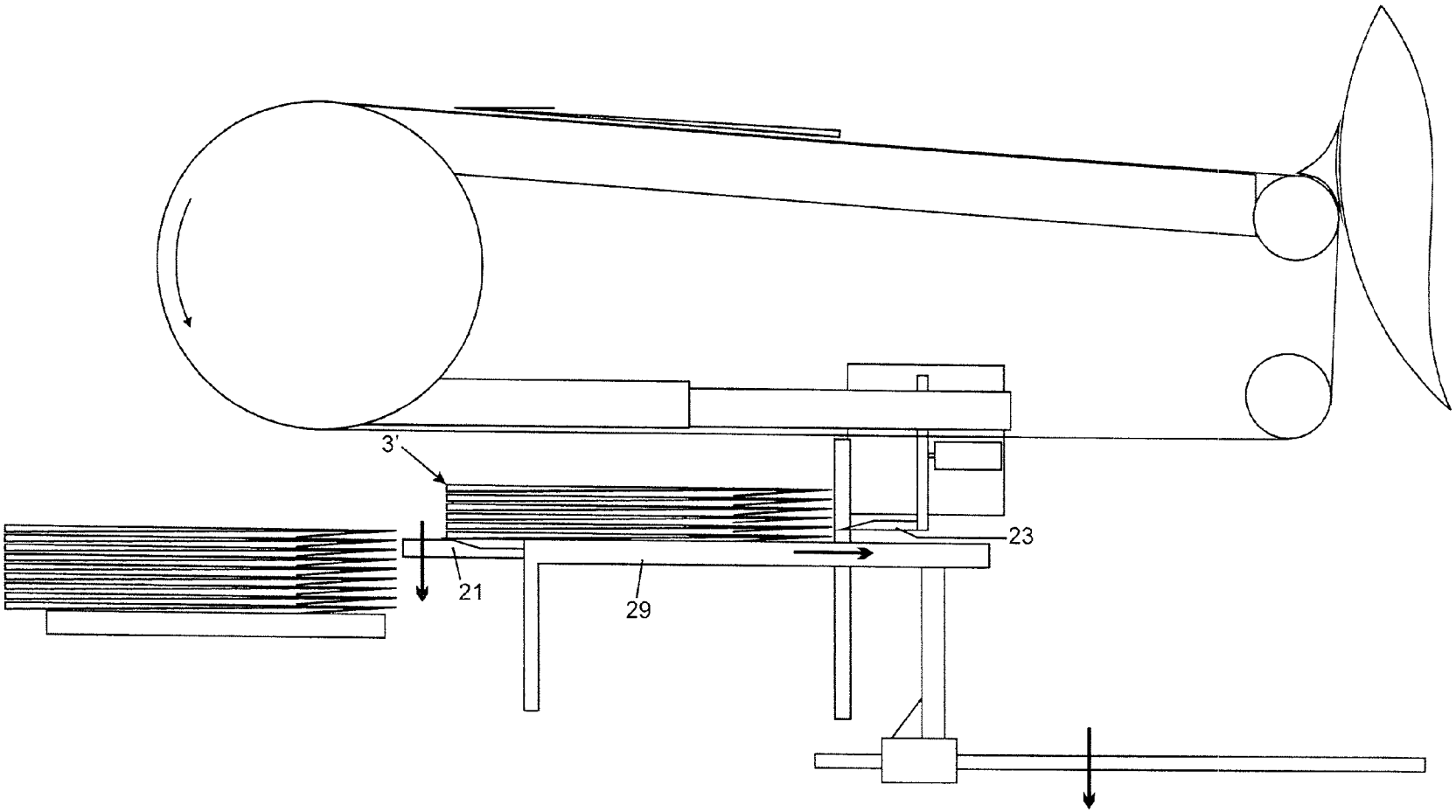

The stack 3 is moved by the slider against the transport direction x of the bag 2 shortly before its release. This direction points away from the separation fingers 23 so that the lower bag 2' of the new stack 3' is displaced and any damage avoided. The stack 3 is moved to a storage device 40 from which it can be further transported or removed. After the stack 3 has completely left the collection table 21, the latter is raised again and positioned under the lower bag of the new stack 3'. This situation is shown in FIG. 6. The stack 3' now lies on the collection table 21, so that the separation fingers 23 can be brought back into the starting position, which is shown in FIG. 7. In addition, the slider 29 can be withdrawn to its starting position, so that now the situation is again produced according to FIG. 1.

The individually necessary components for the described method and described device can be arranged in various ways and can be optionally bonded to one another without departing from the inventive concept. In addition, the displacement devices mentioned as well as all of the necessary drives can be implemented in a variety of ways. Of particular note, however, is the use of linear motors, which allow quick displacements and very accurate positioning. Linear motors can be used for all the above-described displacement devices.

Figure 8:
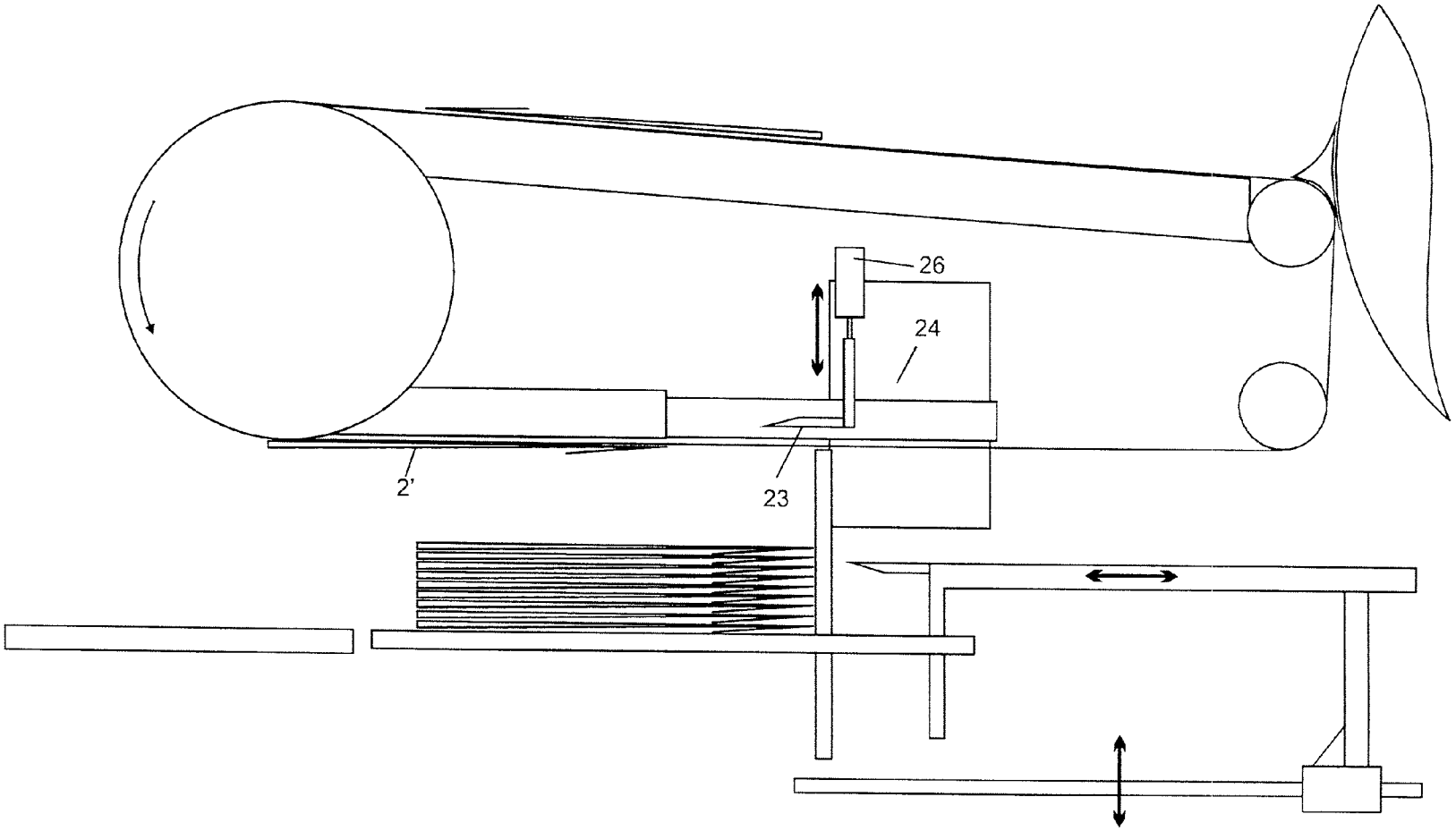
FIG. 8 Device with an alternate displacement direction of the separation device

FIG. 8 shows a device in which the separation finger 23 is not horizontally but vertically displaceable. This is advantageous because during insertion of the separation finger, there is no risk of displacing the bag. In addition, the separation finger 23 can be moved on the release of the upper bag 2 of the stack 3 so that is not necessary to wait until the released bag lies completely on the stack. So this offers a time saving. In the upper position, the separation finger lies between or above the suction channels 12 and/or the extension 14 so that the formation of the stack 3 is not disturbed.

With the illustrated and described apparatus, therefore, stacks of bags with a desired number of bags can be produced and transported away, without the collection process in the apparatus being interrupted or having to be continued at a reduced speed.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

REFERENCE NUMERAL LIST

1 Device for forming stacks of bags
2 Bags
3 Stacks
4 Storage cylinder
5 Separation finger
6 Conveyor device
7 Conveyor belts
8 Pulley
9 Pulley
10 Pulley
11 Suction box
12 Suction box
13 Folded end of the bag 3
14 Extension of the suction box 12
15 Displacement device of the extension 14
16 Prolonged recess
17 Stop
18 Direction of movement of the stop 17
19 Opening
20 Collection table
21 Collection table
22 Movement direction of the collection table 21
23 Separation finger
24 Holding device
25 Double arrow
26 Displacement drive
27 Movement direction of the holding plate 24
28 Double arrow
29 Slider
30 Wedge
31 Positioning element
32 Support facility
33 Carriage
34 Rail arrangement
35 Displacement direction of the slider
36 Double arrow
37 Openings
38 Channel
39 Suction line
40 Storage facility
x Transport direction of the bag just before its release

What is claimed is:

1. A device for forming stacks of individually supplied bags, comprising:

a first transport device for transporting the bags;

a collection point to which the bags are fed by the transport device and at which a stack of the bags is formed;

a release device with which the bags are released from the transport device and deposited at the collection point;

a separation device that is insertable into a portion of the stack at the collection point so as to provide a first stack and a second stack; and a slider that, after the insertion of the separation device, (i) removes the first stack from the collection point in a lateral direction that is substantially perpendicular to a direction in which the bags are deposited at the collection point and (ii) supports the forming second stack, during the removal of the first stack.

2. The device according to claim 1, wherein the separation device includes at least one holding device with which at least a first-stacked bag of the second stack can be held.

3. The device according to claim 1, wherein the separation device includes at least one wedge-shaped finger.

4. The device according to claim 3, wherein the at least one wedge-shaped finger is insertable above the first stack, before a first-stacked bag of the second stack is deposited at the collection point.

5. The device according to claim 1, wherein the separation device includes at least one hole that is subject to a negative pressure.

6. The device according to claim 5, wherein the negative pressure is applied to a first-stacked bag of the second stack so as to secure the first-stacked bag in place during the removal of the first stack.

7. The device according to claim 1, wherein the separation device includes at least one gripper.

8. The device according to claim 1, wherein the bags are paper bags.

9. The device according to claim 1, wherein the slider includes a plurality of bars, and a plurality of positioning elements that are oriented at a right angle to the plurality bars.

10. The device according to claim 9, wherein each of the positioning elements is superposed by at least a wedge that is insertable in a free space produced by the separation device between the first stack and the second stack.

11. A method of forming stacks of individually supplied bags with a device that includes a first transport device for transporting the bags, a collection point to which the has are fed by the transport device and at which a stack of the bags is formed, a release device with which the bags are released from the transport device and deposited at the collection point, a separation device that is insertable into a portion of the stack at the collection point so as to provide a first stack and a second stack, and a slider that, after the insertion of the separation device, (i) removes the first stack from the collection point and (ii) supports the forming second stack during the removal of the first stack, said method comprising:

transporting the bags to the collection point;

releasing the bags from the transport device and depositing the bags at the collection point;

inserting the separation device into the portion of the stack at the collection point so as to provide the first stack and the second stack; and using the slider to (i) remove the first stack from the collection point in a lateral direction that is substantially perpendicular to a direction in which the bags are deposited at the collection point and (ii) support the forming second stack during the removal of the first stack.

12. The method according to claim 11, further comprising a step of applying a vacuum to the first-stacked bag of the second stack so as to secure the first-stacked bag in place during the removal of the first stack.

13. A device for forming stacks of individually supplied bags, comprising a first transport device for transporting the bags;

a collection point to which the bags are fed by the transport device and at which a stack of the bags is formed;

a release device that releases the bags from the transport device and deposits the bags at the collection point;

a separation device that is insertable into a portion of the stack at the collection point so as to provide a first stack and a second stack; and a slider that, after the insertion of the separation device, (i) removes the first stack from the collection point and (ii) supports the forming second stack during the removal of the first stack.

14. The device according to claim 13, wherein the slider removes the first stack from the collection point in a lateral direction that is substantially perpendicular to a direction in which the bags are deposited at the collection point.

15. The device according to claim 13, wherein the separation device includes an aperture that is subject to a vacuum, or a gripping element, configured to secure a first-stacked bag of the second stack in a stationary position during the removal of the first stack.

16. The device according to claim 15, wherein the release device continues to release the bags from the transport device and deposit the bags on the stationary first-stacked bag of the second stack so as to form the second stack while the slider removes the first stack from the collection point.

17. The device according to claim 13, further comprising a collection table upon which the first stack is deposited, said collection table being vertically movable after the first stack has been removed therefrom so as to support the second stack as the slider retracts from the forming second stack.

18. A device for forming stacks of individually supplied bags, comprising:

a first transport device for transporting the bags;

a collection point to which the bags are fed by the transport device and at which a stack of the bags is formed;

a release device that releases the bags from the transport device and deposits the bags at the collection point;

a separation device that is insertable into a portion of the stack at the collection point so as to provide a first stack and a second stack; and a slider that, after the insertion of the separation device, (i) removes the first stack from the collection point and (ii) supports the forming adjacent second stack during the removal of the first stack.

19. The device according to claim 18, wherein the adjacent second stack is located above the first stack.

* * * * *